United States Patent [19]

Fiock

[11] Patent Number: 4,992,067

[45] Date of Patent: Feb. 12, 1991

[54] METHOD OF MANUFACTURING A COLOR CATHODE-RAY TUBE

[75] Inventor: Ted J. Fiock, Warren, Ind.

[73] Assignee: RCA Licensing Corp., Princeton, N.J.

[21] Appl. No.: 426,248

[22] Filed: Oct. 25, 1989

[51] Int. Cl.[5] ..... H01J 9/00

[52] U.S. Cl. ..... 445/30; 445/59; 228/214

[58] Field of Search ..... 445/30, 59, 68; 228/214, 218, 222

[56] References Cited

U.S. PATENT DOCUMENTS

| | | | |
|---|---|---|---|
| 3,334,259 | 8/1967 | Shrader | 313/85 |
| 3,724,740 | 4/1973 | Imamura et al. | 445/68 |
| 4,467,242 | 8/1984 | Wilbur et al. | 313/406 |
| 4,605,379 | 8/1986 | Shahan | 445/59 |
| 4,610,636 | 9/1986 | Craig et al. | 445/68 |

OTHER PUBLICATIONS

Products for Productivity, Vortec Product Bulletin, Cincinnati, Ohio.

*Primary Examiner*—Kenneth J. Ramsey

*Attorney, Agent, or Firm*—Joseph S. Tripoli; Dennis H. Irlbeck; Vincent J. Coughlin, Jr.

[57] ABSTRACT

The invention describes a method of manufacturing a color cathode-ray tube having a color selection electrode attached to a plurality of support studs distributed about and affixed to an interior surface portion of a faceplate panel. The manufacturing steps include: attaching a plurality of support means, each of which includes stud-engaging means, and at least one of the stud-engaging means comprising a washer having a stud-receiving aperture therethrough, to the color selection electrode; positioning the color selection electrode within the faceplate panel with the stud-engaging means positioned on the support studs; and, then, welding the washer to the support means. The method is improved over the prior method, which utilized a mechanical shield for preventing weld-generated debris from contacting the faceplate panel and/or the color selection electrode, by directing a stream of air, during the welding step, between the faceplate panel and the color selection electrode toward the stud having the washer thereon sufficient to direct the weld-generated debris away from the faceplate panel.

2 Claims, 2 Drawing Sheets

METHOD OF MANUFACTURING A COLOR CATHODE-RAY TUBE

This invention relates to the manufacturing of a color cathode-ray tube and, particularly, to welding a washer to a color selection electrode support means using a stream of air as a weld-splash shield.

BACKGROUND OF THE INVENTION

U.S. Pat. No. 3,334,259 issued to T. M. Shrader on Aug 1, 1967 discloses a color selection electrode, or shadow mask, having a plurality of strap-like support springs, usually four, attached to a frame which supports the mask. The mask-frame assembly is positioned within a faceplate panel and is spaced therefrom using a suitable spacer device. The support springs are depressed toward the mask frame and flat washers are inserted over support studs embedded into the interior wall of the faceplate. The washers are located between the support springs and the studs and at this point in the manufacturing process the washers are free to move, relative to the support springs, to facilitate obtaining the precisely desired distance, called the Q-spacing, between the mask and the faceplate and a precise alignment of the stud-receiving apertures of the washers with the support studs. The washers are then attached to the support springs using temporary tack welds. Then, with the completely assembled mask assembly removed from the panel, a more secure weld using larger equipment is provided. The reason for making the initial tack weld is that larger welding equipment cannot easily be fitted into the space between the mask frame and the faceplate panel sidewall when the mask assembly is disposed within the panel. A drawback of the patented structure is that the tack weld tends to be relatively weak and often breaks when the mask assembly is removed from the panel. Additionally, the insertion and removal process for final welding is inefficient and adds to the assembly cost of the tube.

In order to improve manufacturing efficiency, it is now usual for the studs to be affixed at a controlled height above the surface of the panel to obtain the desired Q-spacing. Four studs are usually provided, one near the midpoint of the upper long side of the sidewall, one near the midpoint of each of the short sides of the sidewall, and one displaced slightly from the midpoint of the lower long side so that the mask cannot be inserted incorrectly. The support springs attached to the upper long side and the short sides of the mask now include stud-engaging apertures in their distal end; however, the support spring that engages the stud located on the lower long side of the panel continues to use a washer disposed between the distal end of the spring and the stud to provide a manufacturing tolerance to compensate for manufacturing variations or tolerances in stud placement and spring location.

U.S. Pat. No. 4,467,242 issued to L. P. Wilbur, Jr., et al. on Aug. 21, 1984 discloses an off-set washer which provides additional compression of the support spring to which the washer is attached. The height of the off-set can be adjusted to provide sufficient space between the mask frame and the faceplate panel sidewall to permit the washer to be permanently welded to the distal end of the support spring.

It is known that electrical resistance welding frequently produces weld splash, or weld-generated debris, consisting of metal particles of the joined parts.

This weld splash is initially molten and thus usually adheres to the surface on which it lands. To minimize weld-splash, which can become dislodged to create particles within the tube, it is known to shield the adjacent sidewall of the faceplate with a mechanical device, such as a plastic strip, which functions as a protective shield. Such a shield, however, infringes on the available welding space and must be accurately located if it is to function properly. An improperly located shield, in addition to being ineffective in preventing weld splash from impinging on the sidewall of the faceplate panel, can also interfere with the welding electrode, causing improper washer-to-support spring welds.

SUMMARY OF THE INVENTION

A method of manufacturing a cathode-ray tube having a color selection electrode attached to a plurality of support studs distributed about and affixed to an interior surface portion of a faceplate panel includes the steps of: attaching a plurality of support means, each of which includes stud-engaging means, and at least one of the stud-engaging means comprising a washer having a stud-receiving aperture therethrough, to the color selection electrode; positioning the color selection electrode within the faceplate panel with the stud-engaging means positioned on the support studs; and welding the washer to the support means. The method is improved by directing a stream of air, during the welding step, between the faceplate panel and the color selection electrode toward the stud having the washer thereon to direct weld-generated debris away from the faceplate panel.

DETAILED DESCRIPTION OF THE PREFERRED EMBODIMENT

Figure 1:
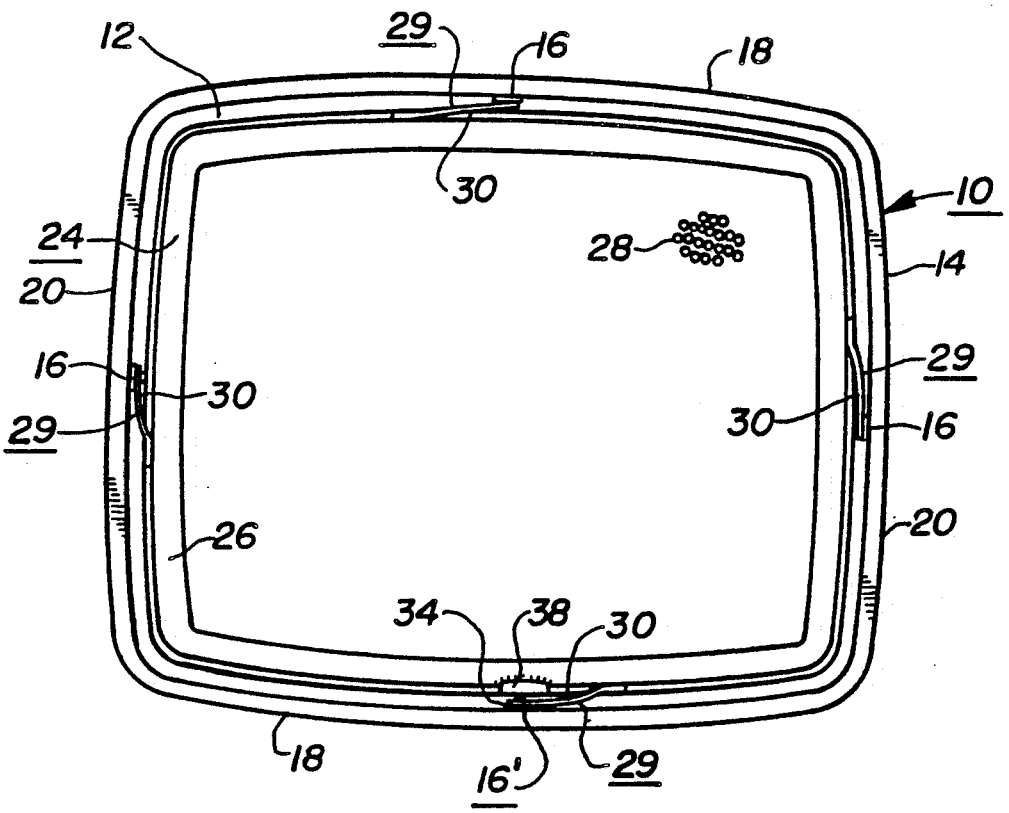
FIG. 1 is a plan view of a cathode-ray tube faceplate panel and color selection electrode.
Figure 2:
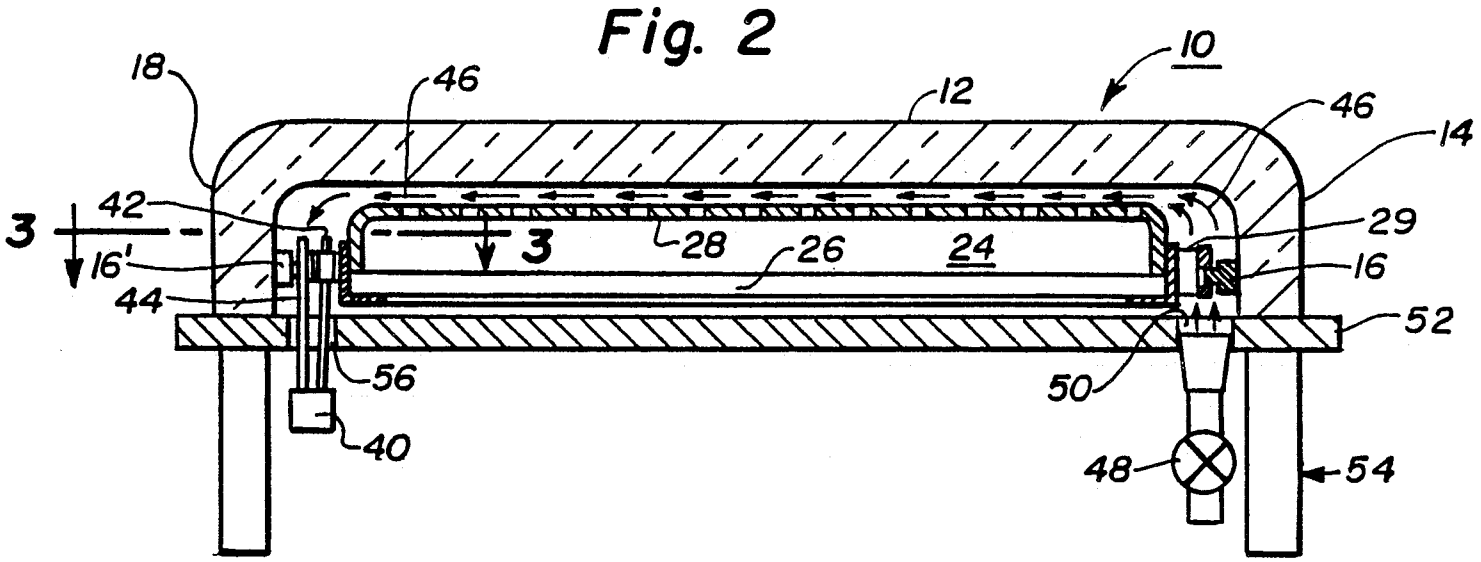
FIG. 2 is a sectional view of the faceplate panel and color selection electrode of FIG. 1 showing the novel step in the manufacturing procedure.

With respect to FIG. 1 and 2, a cathode-ray tube glass faceplate panel 10 comprises a generally rectangular faceplate 12 and a sidewall 14 extending from the periphery of the faceplate. A plurality of electrode mounting studs 16 and 16' extend from the interior surface of the panel sidewall 14. The studs 16 and 16' may be bonded to the surface of the sidewall with, e.g., a glass frit, or they may be embedded in the sidewall by a conventional glass-to-metal seal. In a preferred arrangement, four studs are provided, one stud 16 near the midpoint of the upper long side 18 of the sidewall 14, one stud 16' displaced about 8.53 mm from the midpoint of the lower long side 18 of the sidewall 14, and one stud 16 near the midpoint of each of the two short sides 20 of the sidewall 14. The studs 16 and 16' are preferably located at a predetermined height above the faceplate 12. Each of the studs 16 and 16' (FIG. 3) comprises a cylindrical base 21 and a frustoconical tip 22.

A color selection electrode such as a shadow mask electrode 24, mounted within the faceplate panel 10, includes a frame member 26 and a masking member 28. The frame 26 comprises a generally rectangular loop-shaped rim having an L-shaped cross section. The masking member 28 comprises a multiapertured sheet of metal mounted across the frame 26. The masking member 28 has a surface contour which approximately matches the surface contour of the interior of the faceplate 12.

Figure 3:
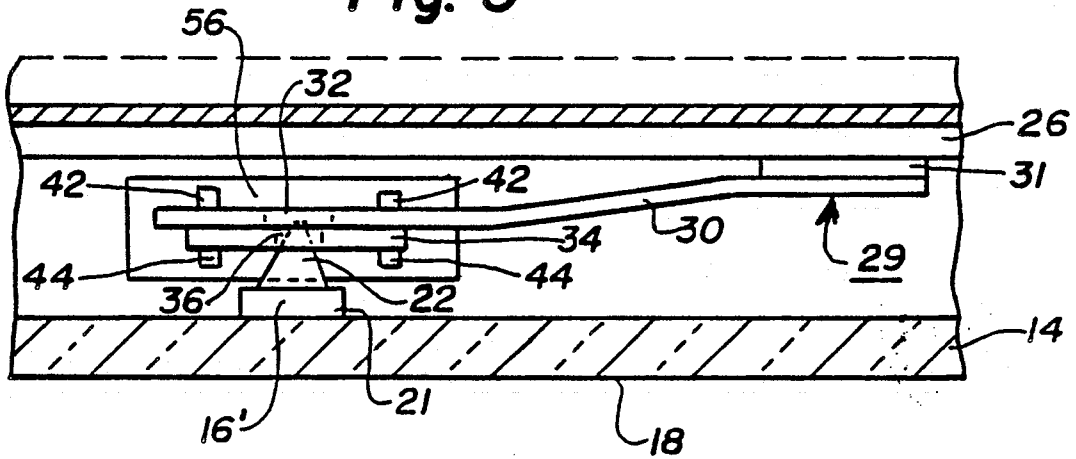
FIG. 3 is a view taken along line 3—3 of FIG. 2.

A plurality of support springs 29 are attached to the mask electrode 24 and support it on the studs 16 and 16'. As shown in FIG. 3, each of the support springs 29 comprises a strap-like element 30 which has it proximal end attached to a temperature compensating bimetallic clip 31. The clip 31 is secured to the side of the frame 26 such as by spot welds. The distal end of each strap-like element 30 is off-set outwardly from the side of the frame and provided with an aperture 32. The aperture 32 is configured to detachably engage the frustoconical tips 22 of the studs to facilitate removably mounting the mask electrode 24 within the panel 10 at a distance, or assumed Q-spacing, above the faceplate 12 which is controlled by the height at which the studs 16 and 16' are attached to the sidewall 14. The mask electrode 24 may be removed and/or remounted by depressing the support springs 29 toward the frame 26 and free of the studs 16 and 16'. The stud 16', which is displaced from the midpoint of the lower long side 18 of the sidewall 14 by about 8.53 mm, assures that the mask electrode 24 cannot be remounted upside down since the nonsymmetrical location of the stud 16' allows only one correct mask mounting orientation. The spring 29, which contacts the stud 16 on the lower long side 18 of the sidewall 14, includes, in addition to the strap-like element 33, a washer 34. The washer 34 includes a stud-receiving aperture 36 which snugly grasps the stud 16'. While the washer 34 is shown as being flat, it should be clear to one skilled in the art that an offset washer, as described in the aforementioned U.S. Pat. No. 4,467,242 also may be used.

In assembling the panel 10 and the shadow mask 24, it is assumed that the location of the studs 16 and 16' provide the desired Q-spacing between the mask member 28 and the faceplate 12 so that electron beams passing through the apertures in masking member 28 will impinge on the red-, green- and blue-emitting phosphor elements which subsequently will be deposited on the interior surface of the faceplate 12.

The proximal end of each of the strap-like members 30 is welded to the bimetallic clips 31 to form the support springs 29 which are affixed to the frame 26. The mask member 28 also is affixed to the frame, as is known in the art, to form the shadow mask 24.

As shown in FIG. 2, the shadow mask 24 is disposed within the faceplate panel 10 so that the apertures 32 in the distal ends of the strap-like elements 30 engage the tips 22 of the three studs 16. The distal end of the strap-like element 30 adjacent to the stud 16', which is displaced from the midpoint of the lower long side 18 of the sidewall 14, is depressed toward the frame 26. The washer 34 is inserted over the tip 22 of the stud 16', between the strap-like element 30 and the stud, so that the stud tip 22 is snugly received within the stud-receiving aperture 36 of the washer. A welding apparatus 40 having welding electrodes 42 and 44 is brought into contact with the strap-like member 30 and the washer 34. Unlike prior manufacturing methods where it was necessary to position a weld-splash shield between the workpiece, comprising the member 30 and the washer 34, and the long side 18 of the glass sidewall 14, the novel method directs a stream or curtain of high velocity air, represented by the arrows 46, from the top side 1 or 12 o'clock position, of the panel 10, between the panel 10 and the shadow mask 24 toward the stud 16' where the welding operation is to take place. The air stream prevents weld-splash from being attached to the interior surface of the sidewall 14.

The air stream 46 is generated by a commercially available air amplifier 48 which injects the air stream 46 through a rectangular slot 50 formed through a support surface 52 of a panel-mask assembly unit 54. An opening 56 also is provided through the support surface 52 to accommodate the welding electrodes 42 and 44 and to provide a means for the air to exit the assembly unit 54.

It has been found that an output air flow of about 3600 feet per minute (fpm) is sufficient to deflect the weld-splash, generated during the welding of the washer 34 to the strap-like member 30, away from the sidewall 14 of the panel 10 and out of the panel-mask assembly.

One suitable type of air amplifier is a curtain transvector available from Vortec, Cincinnati, Ohio. The curtain transvector provides a 30.48 cm (12 inch) wide air curtain. The unit consumes approximately 52 scfm (cubic feet per minute at specified conditions of temperature and pressure) of air while supplying about 1300 scfm of output air flow.

GENERAL CONSIDERATIONS

A major source of tube scrap is caused by particles within the tube envelope which can cause "blocked apertures" in the shadow mask or electrical problems in the electron gun. Weld-splash dislodged from the sidewall, or otherwise contained within the tube, creates conductive particles which contribute to the aforementioned problems. The novel method of using an air curtain rather than a weld-splash shield has reduced scrap on the 26V product on which it was tested below that of the 25V product made on the same equipment but using a conventional weld-splash shield. It is believed that the high velocity air curtain is sufficient to direct the relatively small particles of weld-splash away from the sidewall of the faceplate panel, and out of the interior portions of the mask-panel subassembly.

What is claimed is:

1. In a method of manufacturing a cathode-ray tube having a color selection electrode attached to a plurality of support studs distributed about and affixed to an interior surface portion of a faceplate panel by a plurality of support means each of which includes stud-engaging means, at least one of said stud-engaging means includes a washer having a stud-receiving aperture therethrough, said washer being welded to said support means, wherein the method comprises the steps of: attaching said plurality of support means to said color selection electrode; positioning the color selection electrode within the faceplate panel with the stud-engaging means positioned on said support studs; and welding said washer to said support means, wherein the improvement comprises directing a stream of air, during said welding step, between said faceplate panel and said color selection electrode toward said stud having said washer thereon, said stream of air being sufficient to direct weld-generated debris away from the faceplate panel.

2. The method described in claim 1 further including the step of providing said stream of air from a location opposite said stud having said washer thereon.

* * * * *